United States Patent [19]

Gics

[11] Patent Number: 4,625,088

[45] Date of Patent: Nov. 25, 1986

[54] CENTER WALL WITH SLOPED ENDS FOR A MICROWAVE HEAT APPLICATOR

[76] Inventor: Paul W. Gics, 92 Merriman Rd., Sewickley Heights, Pa. 15143

[21] Appl. No.: 795,786

[22] Filed: Nov. 7, 1985

[51] Int. Cl.[4] ..... H05B 6/72

[52] U.S. Cl. ..... 219/10.55 A; 219/10.55 F; 333/230; 333/248

[58] Field of Search ..... 219/10.55 A, 10.55 F, 219/10.55 R, 10.55 E, 10.55 D, 10.55 M; 333/230, 239, 248, 113, 114; 34/1

[56] References Cited

U.S. PATENT DOCUMENTS

| | | | |
|---|---|---|---|
| 2,896,174 | 7/1959 | Fox | 333/113 X |
| 2,948,863 | 8/1960 | Honda | 333/113 X |
| 3,783,221 | 1/1974 | Soulier | 219/10.55 A |
| 3,999,026 | 12/1976 | Böling | 219/10.55 A |
| 4,060,443 | 11/1977 | Balla | 219/10.55 A X |
| 4,160,144 | 7/1979 | Kashyap et al. | 219/10.55 F |

*Primary Examiner*—Philip H. Leung
*Attorney, Agent, or Firm*—Lawrence Hager

[57] ABSTRACT

A heat applicating device having a resonator divided into a plurality of chambers by one or more energy radiating wall like members. The energy radiating wall member is coupled to a microwave energy source at a point on one edge thereof whereby a magnetic field is generated along the opposite (upper) edge of said wall member. An elongate slot is provided in the resonator generally above the upper energy radiating edge portion of the wall member. The ends of the wall member are sloped to provide a gradual termination of the electrical field.

11 Claims, 3 Drawing Figures

CENTER WALL WITH SLOPED ENDS FOR A MICROWAVE HEAT APPLICATOR

FIELD OF THE INVENTION

The present invention relates to a heating device which is fed with microwave energy and, more particularly, to a heat applicator for heat sealing thermoplastic layers, packagings of paper or cardboard and the like.

PRIOR ART STATEMENT

Various types of microwave ovens and applicators have hitherto been proposed.

In one prior art microwave energy heating device, such as described in U.S. Pat. No. 3,999,026 issued Dec. 21, 1976 to Göran Böling, a long resonator is fed microwave energy by a waveguide. The resonator is divided into parallel chambers (10 and 12) by a metal wall (14). The feeding of microwave energy takes place in such a way that the magnetic field is forced to close itself around the metal wall.

The energy radiating metal wall (14) has a generally rectangular shape with vertical end wall portions or edges. The vertical end wall portions are provided apparently for the purpose of providing an electric field of constant intensity along the whole length of the energy radiating wall (14).

The present applicant discovered that this abrupt termination of the electrical field at the vertical end wall portions, as taught by the above noted prior art patent, produced leakage radiation about the radiator ends. Since such devices are used in the proximity of individuals, it is imperative to seek means for reducing or eliminating leakage radiation from the radiator.

Accordingly, a disadvantage is presented by the above discussed prior art heating device in order to meet its intended purpose of producing a constant intensity electrical field along the whole length of the energy radiating wall (14).

Other prior art patents of interest include U.S. Pat. Nos.: 4,276,462 issued June 30, 1981 to Per O. Risman; 4,160,145 issued July 3, 1979 to Werner Rudggeberg; 4,295,908 issued Oct. 20, 1981 to Hans G. Schaefer et al; 4,188,769 issued Feb. 19, 1980 to Marvin L. Bright, Jr.; 3,293,765 issued Dec. 27, 1966 to R. Winkler et al; and 3,518,396 issued June 30, 1970 to T. L. Wilson et al.

These patents are mentioned as being representative of the prior art and other pertinent references may exist. None of the above cited patents are deemed to affect the patentability of the present claimed invention.

The present invention involves a novel combination of features combined in such a way as to afford a solution to the difficulties and problems encountered with the prior art.

For example, in contrast to the prior art, the present invention provides a microwave energy heat applicator having an energy radiating wall or hot-tongue with sloped ends. The sloped wall ends provide a gradual termination to the electrical field thereby substantially reducing or eliminating leakage radiation from the ends of the radiator unit.

SUMMARY OF THE INVENTION

The resonator type heating device has an elongate rectangular configuration with an elongate slot. The resonator being divided into two or more chambers by a metal wall which is fed microwave energy for producing an electric/magnetic field. The electric field may be utilized to produce heating in a dielectric material placed in or about the slot. The metal wall comprises an elongate member supported along one edge by a portion of the resonator and having its side edges or end wall portions contoured or sloped so as to provide gradual termination of the electrical field.

Accordingly, it is an object of the present invention to provide a new and improved heating device fed with microwave energy.

It is a further object of the present invention to provide a microwave heat applicator having an energy radiating member with sloped or contoured end wall portions.

It is a further object of the present invention to provide a microwave energy fed heat applicator having an energy radiating element with side walls designed to substantially reduce leakage radiation from the ends of the applicator.

It is a further object of the present invention to provide a microwave energy fed heat applicator having an energy radiating elongate wall with sloped ends for effecting gradual termination of the electrical field generated about said wall.

BRIEF DESCRIPTION OF THE DRAWINGS

Other objects and advantages of the present invention will be evident from the following detailed description when read in conjunction with the accompanying drawings which illustrate the preferred embodiment of the present invention. Similar reference numerals refer to similar parts throughout.

DESCRIPTION OF THE PREFERRED EMBODIMENT

Figure 1:
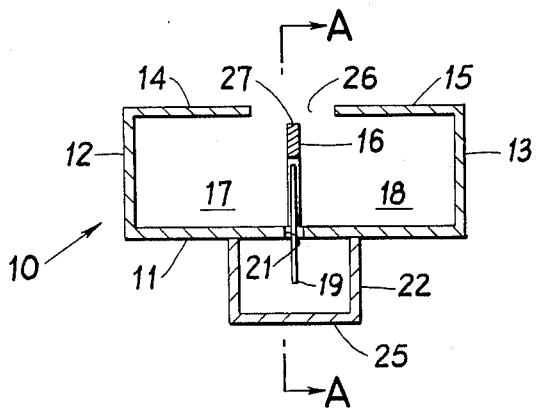
FIG. 1 is a schematic illustration of a resonator in cross section.

Referring to the drawings, there is shown a resonator or microwave heat applicator 10 having a generally rectangular configuration comprising elongate bottom wall 11, side walls 12 and 13, two partial upper walls 14 and 15, and a center wall or hot-tongue member 16. The center wall 16 basically divides the resonator 10 into two chambers 17 and 18 and is affixed in an upright manner to bottom wall 11.

The microwave energy may be coupled into the resonator by means of a conductor (not shown) or a receiving antenna 19. The receiving antenna 19 may be connected to a V-shaped slot 20 in wall member 16 and projects downwardly through an opening 21 in the resonator 10 into the interior space of waveguide 22. Waveguide 22 is affixed to a portion of bottom wall member 11. A magnitron or microwave energy source 23 is coupled to a portion of waveguide 22 and has a transmitting antenna 24 projecting upwardly into waveguide 22 through an opening 25 therein.

With microwave energy being transmitted by magnitron 23 to energy radiating wall member 16, via transmitting antenna 24, waveguide 22 and receiving antenna 19, a magnetic field is produced about wall member 16. This magnetic field produces an electric field having a generally constant intensity about the longitudinal space of slot 26 in proximity to the upper flat edge portion 27 of wall 16. Thus, an electric field of substantially constant intensity is generated along a region 28 of resonator 10 which is less than the length of wall member 16 and, therefore, less than the whole length of resonator 10.

Center wall 16 has sloped or contoured end wall portions or edges 29 and 30. The slope or contour of end walls 29 and 30 may be empirically determined to effect substantial or full termination of the electrical field gradually over the length of sloped walls 29 and 30.

Figure 2:
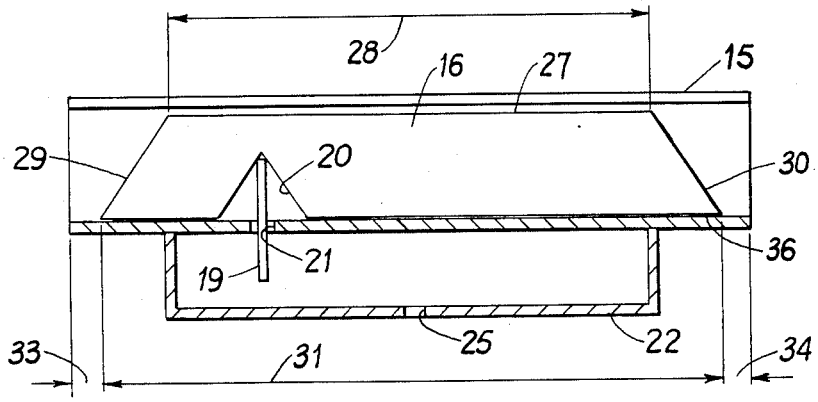
FIG. 2 is a longitudinal sectional view of the resonator illustrated in FIG. 1 taken along line A—A.

With particular reference now to FIG. 2, the length 31 of wall member 16 is less than the length 32 of resonator 10 such that a dual electrical field termination may be effected. The distance 33 and 34 between wall member ends 29 and 30 to the respective ends of resonator 10 may be selected at a portion of a wavelength to effect a partial termination of the electrical field. In addition, gradual electrical field termination is effected over the sloped wall ends 29 and 30. The slope of wall ends 29 and 30 and the distances 33 and 34 may be empirically determined to jointly maximize electrical field termination and, therefore, minimal radiation leakage at the ends of radiator or heat applicator 10.

Figure 3:
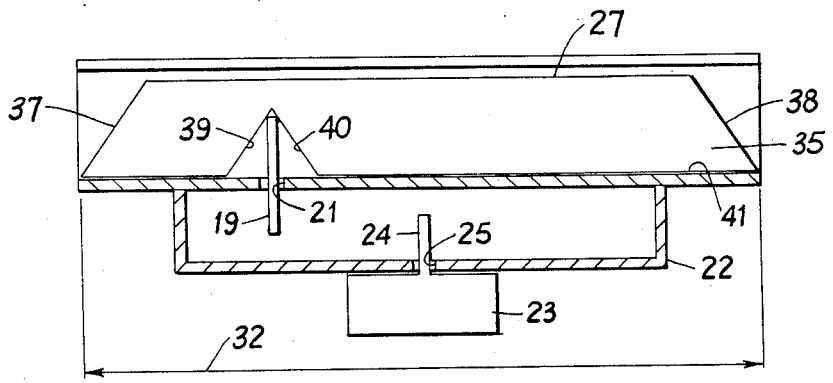
FIG. 3 is a longitudinal view, partly in section, of another embodiment of the invention.

With reference now to FIG. 3, an alternative construction of the heat applicator is shown. The hot-tongue 35 shown in this drawing is similar to that shown in FIGS. 1 and 2 with the exception that its base 41 length is approximately equal to or slightly less than the length 32 of the heat applicator 10. In this embodiment, the slope or contour of the end walls 37 and 38 are utilized to effect the desired termination of the electrical field.

It should be noted at this time that the slop of the walls 39 and 40 may be substantially parallel with end walls 37 and 38, respectively.

It is to be understood that the above described embodiments are illustrative of the application of the principles of the present invention. Other arrangements may be devised by those skilled in the art without departing from the spirit and scope of the claimed invention.

I claim:

1. A microwave energy resonator device having particular utility for heating material by microwave energy with being provided microwave energy from a microwave energy source, comprising:

housing means having a pair of side walls and a bottom wall and an upper wall forming an elongate rectangular configuration having two open ends, said upper wall having elongate slot formed therein dimensioned for receiving the material to be heated said slot extending the entire length of said upper wall;

partition wall means having a generally trapezoidal configuration with substantially parallel upper and lower wall edges and a pair of sloped end wall edges, said upper wall edge having a length less than said lower wall edge, said lower wall edge having a portion affixed to the bottom wall of said housing such that said upper wall edge being supported proximate with said slot and recessed within said housing means;

whereby with said partition wall means being provided microwave energy an electric field will be produced about said upper wall edge with said electric field being terminated gradually about the sloped end wall edges for defining a heating zone about a portion of said slot being less than the entire length of said slot.

2. A microwave energy resonator device as in claim 1, wherein:

the bottom wall of said housing has a hole therein dimensioned for receiving a conductor.

3. A microwave energy resonator device as in claim 1, wherein:

the bottom wall of said housing has a hole therein dimensioned for receiving an antenna.

4. A microwave energy resonator device as in claim 1, wherein:

the lower wall edge of said partition wall has one or more surface portions contoured for gradually coupling microwave energy to said partition wall.

5. A microwave energy resonator device as in claim 1, wherein:

the lower wall edge of said partition wall has one or more notches formed therein each having at least one sloped surface portion being generally parallel with one of the sloped end wall edges of said partition wall means.

6. A microwave energy resonator device as in claim 1, wherein:

the lower wall edge of said partition wall has a V-shaped notch formed therein with each sloped side wall forming said V-shaped notch being parallel with a respective one of said sloped end wall edges of the partition wall means.

7. A microwave energy resonator device as in claim 1, wherein:

the lower wall edge of said partition wall means has a length less than the length of said housing means and the end wall edges are sloped upwardly and inwardly from the lower wall edge whereby the electrical field produced about the upper wall edge is gradually terminated along the sloped end wall edges and the spaces between the partition wall means and the ends of the housing means.

8. A microwave energy resonator device as in claim 1, wherein:

the lower wall edge of said partition wall means has a length equal to or slightly less than the length of said housing means and the end wall edges are sloped upwardly and inwardly from the ends of the lower wall edge whereby an electrical field generated about the upper wall edge is substantially gradually terminated about the sloped end wall edges.

9. A microwave energy resonator device as in claim 1, including:

waveguide means coupled to a portion of said housing means, an antenna connected to a portion of said partition wall means and projecting within said waveguide means, a microwave energy source coupled to a portion of said waveguide means and having a transmitting antenna projecting within said waveguide means.

10. A microwave heat applicator device comprising:

housing means having a pair of side walls (12,13) and a bottom wall (11) and an upper wall (14,15) forming an elongate configuration having two open ends, said upper wall having an elongate slot (26) traversing the length of said upper wall, said bottom wall having a hole (21) dimensioned for receiving an antenna;

partition wall means (16) having a generally trapezoidal shape with upper (27) and lower (36 or 41) wall edges and a pair of sloped end wall edges (29,30), said partition wall having a length (31) equal to or less than the length (32) of said lower wall edge, said lower wall edge being mounted to a portion of said bottom wall with said upper wall edge being cantilevered recessed within said housing means supported proximate to and extending parallel with a portion of said slot, said upper wall edge having a length (28) substantially less than the length of said slot, said lower wall edge (36 or 41) having a V-shaped notch formed therein with its apex being located above the hole in said bottom wall;

waveguide means (22) affixed to a portion of said bottom wall (11) and having a hole (25) formed therein;

first antenna means connected about the apex of said partition wall and projecting through the hole (21) in said bottom wall and into an interior space of said waveguide means;

microwave energy source means affixed to a portion of said waveguide means and having a second antenna means projecting through the hole (25) in said waveguide means and into the interior space of said waveguide means;

whereby with said microwave energy being coupled to said partition wall an electric field being produced about said upper wall edge (27) with said electric field being substantially terminated gradually about the sloped end wall edges (29,30) for defining a heating zone about a portion of said slot being less than the entire length of said slot.

11. A microwave heat applicator device as in claim 10, wherein:

the sloped end wall edges (29,30) each being parallel with a respective sloped wall surface defining said V-shaped notch.

* * * * *